US005415000A

United States Patent [19]

Mumford et al.

[11] Patent Number: 5,415,000

[45] Date of Patent: May 16, 1995

[54] LOW NOX COMBUSTOR RETRO-FIT SYSTEM FOR GAS TURBINES

[75] Inventors: Stephen E. Mumford, Longwood; David M. Parker, Oviedo, both of Fla.

[73] Assignee: Westinghouse Electric Corporation, Pittsburgh, Pa.

[21] Appl. No.: 259,106

[22] Filed: Jun. 13, 1994

[51] Int. Cl.[6] ..... F02C 3/14

[52] U.S. Cl. ..... 60/747; 60/740

[58] Field of Search ..... 60/740, 746, 739, 733, 60/747, 737, 39.31, 39.36, 39.37

[56] References Cited

U.S. PATENT DOCUMENTS

| | | | |
|---|---|---|---|
| 4,850,196 | 7/1989 | Scalzo et al. | 60/740 |
| 4,890,453 | 1/1990 | Iwai et al. | 60/746 |
| 4,898,001 | 2/1990 | Kuroda et al. | 60/737 |
| 5,081,843 | 1/1992 | Ishibashi et al. | 60/753 |
| 5,121,597 | 6/1992 | Urushidani et al. | 60/747 |
| 5,199,265 | 4/1993 | Borkowicz | 60/746 |
| 5,201,181 | 4/1993 | Ohmori et al. | 60/747 |
| 5,259,184 | 11/1993 | Borkowicz et al. | 60/737 |
| 5,274,991 | 1/1994 | Fitts | 60/39.37 |
| 5,357,745 | 10/1994 | Probert | 60/39.37 |
| 5,359,847 | 11/1994 | Pillsbury et al. | 60/737 |

FOREIGN PATENT DOCUMENTS

| | | | |
|---|---|---|---|
| 0183720 | 7/1990 | Japan | 60/737 |

*Primary Examiner*—Timothy S. Thorpe

[57] ABSTRACT

Apparatus for retro-fitting low NOx combustors in a conventional gas turbine using the existing openings in the cylinder casing and without any significant alteration of the turbine apparatus. Each one of the low NOx combustors is mounted by a nozzle block to the cylinder casing over an existing opening sized for a conventional combustor, the nozzle block having a plurality of fuel nozzles for spraying fuel into said combustor. The nozzle block has a pilot nozzle aperture and a plurality of annular fuel passages such that when the nozzle block is mechanically connected to the combustor the nozzles are in flow communication with the fuel passages. The nozzle block is sized such that one end can be flushly mounted to the cylinder casing over the existing opening. A fuel supply adapter having a plurality of manifold passages is connected to the nozzle block such that the manifold passages are in flow communication with a supply of fuel and also with the fuel passages such that fuel is supplied to the nozzles through the fuel passages in the nozzle block. A pilot nozzle is in flow communication with a supply of fuel and extends through the pilot nozzle aperture and into the combustor for creating a pilot flame in the combustor.

9 Claims, 3 Drawing Sheets

LOW NOX COMBUSTOR RETRO-FIT SYSTEM FOR GAS TURBINES

FIELD OF THE INVENTION

The present invention relates to the combustor section of gas turbine power stations. More specifically, the present invention relates to apparatus for retro-fitting conventional gas turbines to provide for installation of low NOx combustor systems using the existing openings in the turbine cylinder and without significant alteration of the cylinder.

BACKGROUND OF THE INVENTION

In a gas turbine, the compressor section produces compressed air that is subsequently heated by burning fuel in a combustion section. The hot gas from the combustion section is directed to a turbine section where the hot gas is used to drive a rotor shaft for producing power in a known manner. The combustion section is typically comprised of a shell, or cylinder casing, that forms a chamber for receiving compressed air from the compressor section. A plurality of cylindrical combustors are disposed within the chamber and receive the compressed air, along with the fuel to be burned. A duct is connected to the aft end of each combustor and serves to direct the hot gas from the combustors to the turbine section.

Conventional industrial gas turbines that have dual fuel capability, i.e., burn natural gas fuel and liquid fuel, have diffusion type burners in the combustors which require only one supply pipe for gas and one supply pipe for liquid fuel. Accordingly, in order to mount the combustor and the accompanying fuel supply lines and nozzles on the turbine cylinder casing, it has previously only been necessary to provide a relatively small aperture in the cylinder casing. In such conventional gas turbines, the burner nozzles are bolted onto the outside of the cylinder casing and the combustor flange is mounted to the inner wall of the casing. Accordingly, the burner nozzles extend through the aperture in the casing and the necessary fuel supply lines are connected to the nozzles outside of the casing.

In order to control environmental pollution caused by gas turbines, it is necessary to reduce the levels of NOx emissions caused by the burning of fuel at high temperatures. In the conventional gas turbines described above, NOx emissions have been controlled by injecting steam and water into the combustors to reduce the temperature at which the fuels are burned. However, these systems are complex and require the additional components necessary to provide steam to the combustors, thus increasing the cost and complexity of the system. Moreover, the known steam injection systems have not provided the desired reductions in pollution levels.

In order to obviate the pollution problems caused by known conventional turbines and avoid the increased cost and complexity associated with steam injection systems, turbine systems have been developed which include newly designed low NOx combustors. These low NOx combustors provide for reduced pollution levels by operation of the combustors in a premix operation that is known in the art, rather than the diffusion burn operation of conventional turbines. Thus, all of the components necessary for the control of NOx emissions are contained within these new low NOx combustors.

However, known low NOx combustors are significantly larger than conventional combustors. Also, these low NOx combustors typically require a pilot nozzle and a two stage main nozzle, thus requiring six fuel supply lines for each combustor, three lines for gas and three lines for liquid fuel. Therefore, as compared to conventional combustor systems, these low NOx combustors systems are significantly larger and comprise more structure that muse be installed into the turbine cylinder. Although new gas turbine power stations can be built with low NOx combustors by designing the new cylinder casing to account for the increased size and complexity of the low NOx combustor apparatus, it is not possible to directly install these larger combustor systems in the relatively small existing aperture of the cylinder casing of conventional turbines. Moreover, it is not feasible to alter the size of the existing cylinder aperture to account for the larger size of the low NOx combustors.

Thus, there is need for apparatus for retro-fitting existing gas turbines easily and at low cost so that low NOx combustors, along with the necessary fuel supply and nozzle structures, can be installed using the existing openings in the cylinder casing and without significant alteration of the casing. The present invention provides a low NOx combustor retro-fit system which satisfies that need.

SUMMARY OF THE INVENTION

A gas turbine comprises a compressor for producing compressed air and a cylinder casing for receiving the compressed air, the cylinder casing having an aperture. A low NOx combustor is mounted to the cylinder casing over the aperture by a nozzle block, the nozzle block having a plurality of fuel nozzles for spraying fuel into said combustor. The nozzle block has a pilot nozzle aperture and a plurality of annular fuel passages such that when the nozzle block is mechanically connected to the combustor the nozzles are in flow communication with the fuel passages. A fuel supply adapter having a plurality of manifold passages is connected to the nozzle block such that the manifold passages are in flow communication with a supply of fuel and also with the fuel passages such that fuel is supplied to the nozzles through the fuel passages in the nozzle block. A pilot nozzle is in flow communication with a supply of fuel and extends through the pilot nozzle aperture and into the combustor for creating a pilot flame in the combustor. Thus, low NOx combustors can be installed in a conventional gas turbine using the existing aperture in the cylinder casing and without any significant alteration of the turbine apparatus.

DETAILED DESCRIPTION OF THE PREFERRED EMBODIMENTS

Figure 1:
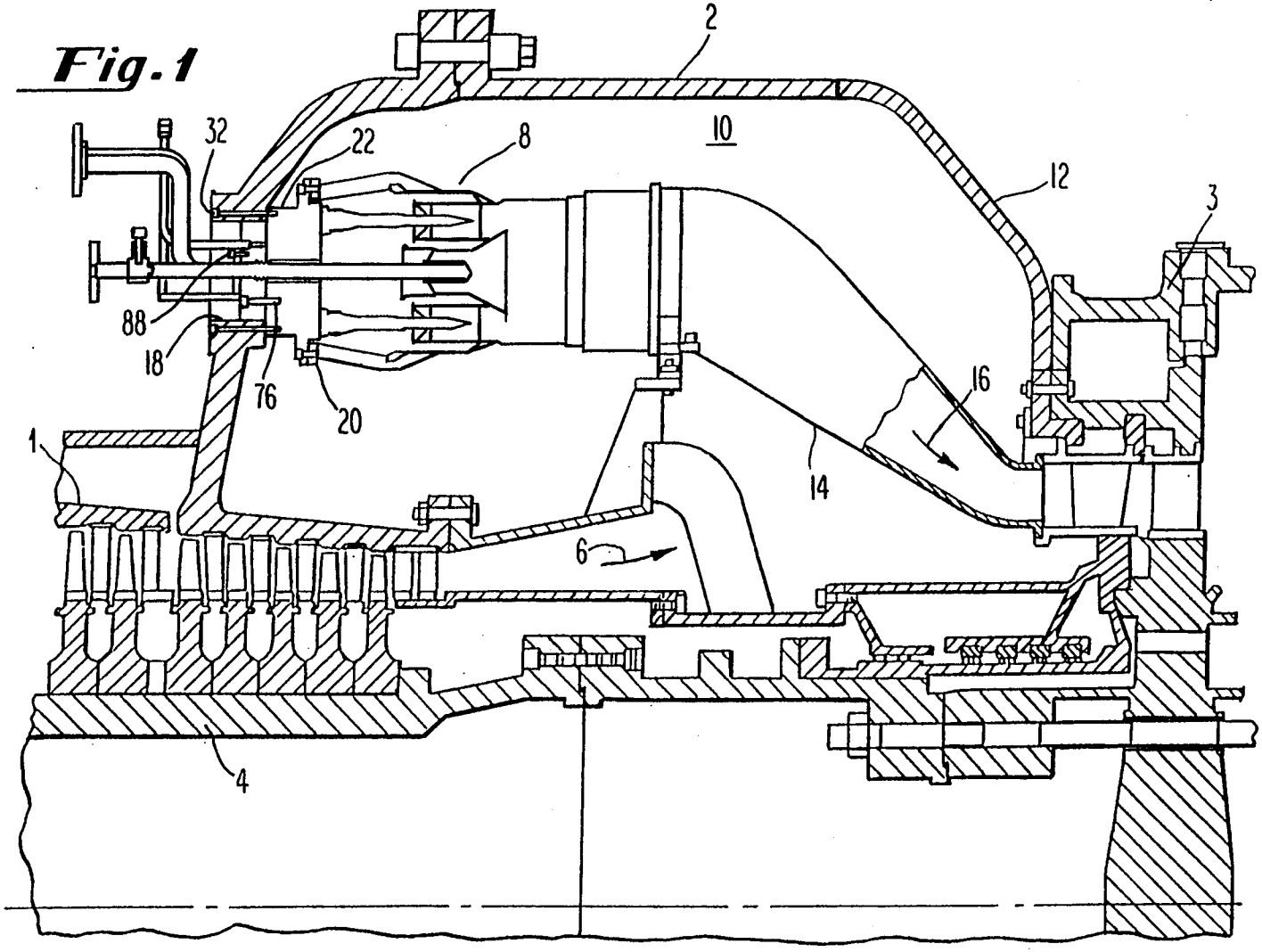
FIG. 1 is a longitudinal cross-section through a portion of a gas turbine incorporating the low NOx combustor retro-fit system of the present invention.

Referring to the drawings, there is shown in FIG. 1 a portion of a longitudinal cross-section of a gas turbine.

The gas turbine is comprised of a compressor section 1, a combustor section 2 and a turbine section 3. A rotating shaft 4 extends through the compressor, combustion and turbine sections. As is conventional, the compressor 1 is comprised of alternating rows of rotating blades and stationary vanes that compress ambient air to produce compressed air 6. The combustion section 2 is comprised of a plurality of low NOx combustors 8, each of which is formed by a cylindrical liner as is known in the art. As is known, the combustors 8 are circumferentially arranged around the rotor 4 within a chamber 10 formed by a cylinder casing 12. The aft end of each combustor is joined to a duct 14, commonly referred to as a "transition duct". (As used herein the term "front" refers to axially upstream and the term "aft" refers to axially downstream.)

A portion of the compressed air 6 enters each of the combustors 8 at its front end along with a supply of fuel, preferably oil and/or natural gas, the fuel being supplied in the manner described in detail below. The fuel is introduced into a combustion zone enclosed by each of the combustors 8, via fuel nozzles, as also described in detail below. In the combustion zone, the fuel is burned in the compressed air to produce a flow of hot gas 16. The hot gas 16 is directed to the turbine section 3, as the hot gas is expanded by duct 14.

As shown in FIG. 1, the front end of a low NOx combustor 8 is excessively large such that it cannot be directly mounted to the cylinder casing 12 at the existing aperture 18 that has previously been used for the direct mounting of smaller conventional combustors. Since the mounting flange 20 at the front end of the low NOx combustor cannot be flushly mounted against the wall of the cylinder casing over aperture 18, the present invention provides a retro-fit system that provides for installation of the low NOx combustors in the existing aperture 18 of the cylinder casing. A retro-fit system in accordance with the present invention provides that low NOx combustors can be directly mounted to the existing transition ducts 14 and no significant alteration of the turbine apparatus and cylinder casing is necessary.

Figure 2:
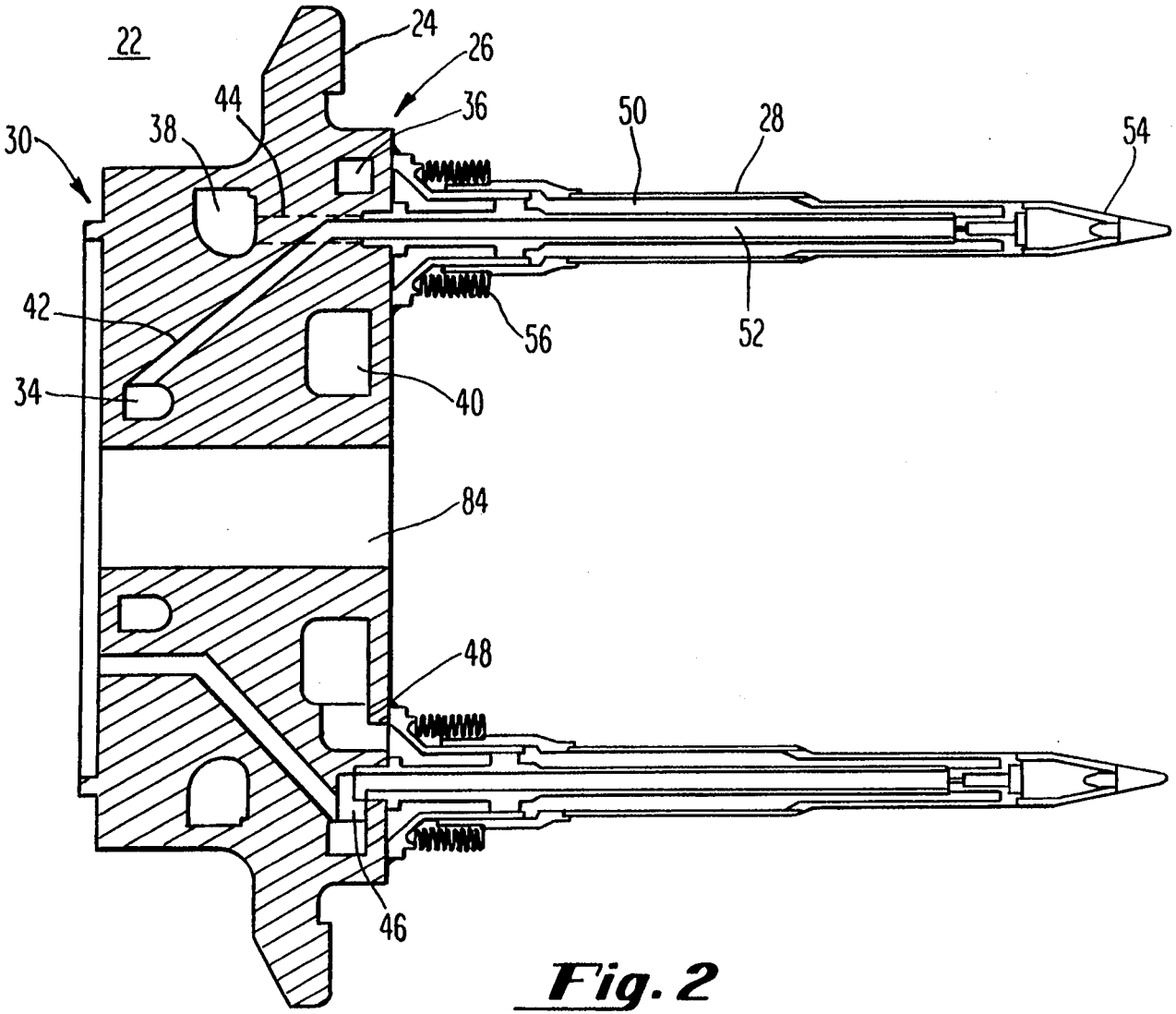
FIG. 2 shows a main fuel nozzle block in accordance with the present invention.

Low NOx combustors 8 are mounted to main fuel nozzle block 22. A preferred embodiment of nozzle block 22 is shown in detail in FIG. 2. Referring to FIGS. 1 and 2, the mounting flange 20 of combustors 8 is bolted to the flange 24 of the nozzle block 22. Accordingly, the main fuel nozzles 28 which project from the aft end 26 of the nozzle block extend into the low NOx combustors for spraying fuel into the combustors in a known manner.

The front end 30 of the main fuel nozzle block 22 is sized to fit over aperture 18 such that the nozzle block is mounted to the cylinder casing 12 by bolts 32 which extend through the cylinder casing and into the front end 30 of the nozzle block. Thus, a large portion of the aft end 30 of the nozzle block 22 is in communication with aperture 18. The flanged front end of conventional combustors have previously been directly mounted to the cylinder casing using only four such bolts 32, with the bolts being evenly spaced around the circumference of the circular aperture 18. However, in order to more firmly secure the main fuel nozzle block, and thus the larger low NOx combustors, to the cylinder casing, four additional holes are drilled into the cylinder casing such that the main fuel nozzle block is mounted with eight bolts 32 evenly spaced around the circumference of the aperture 18. Thus, these four additional holes represent only an insignificant alteration of the turbine structure in order to retro-fit conventional gas turbines with low NOx combustors.

The nozzle block 22 has four annular fuel passages 34, 36, 38, 40 for receiving a supply of fuel. In the embodiment shown, fuel passages 34 and 36 receive a supply of liquid fuel, while fuel passages 38 and 40 are supplied with gas in the manner described below. In the preferred embodiment shown, the nozzles 28 are alternatingly connected into flow communication with the fuel passages such that one nozzle is connected to liquid fuel passage 34 and gas fuel passage 38, via channels 42 and 44 respectively, while an adjacent nozzle is connected to liquid fuel passage 36 and gas fuel passage 40, via channels similar to those shown and labeled as 46 and 48 respectively. In the nozzles 28, gas flows along the outer annular channel 50 and liquid fuel flows along inner bore 52 such that these fuels can be sprayed into the combustors from the nozzle tip 54 in a known manner. Flexible bellows 56 in the connection of the nozzles on the aft end 26 of the nozzle block provide leak free connections and minimize differential thermal expansion stresses in the nozzles.

Figure 3B:
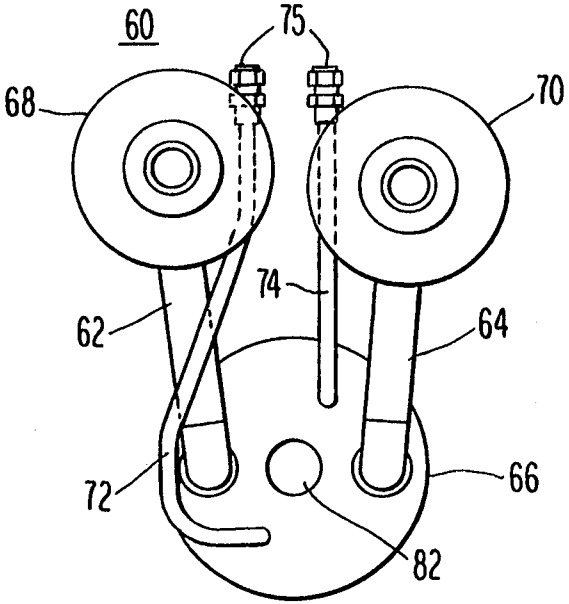
FIGS. 3*a* and 3*b* show a fuel supply adapter in accordance with the present invention.
Figure 3A:
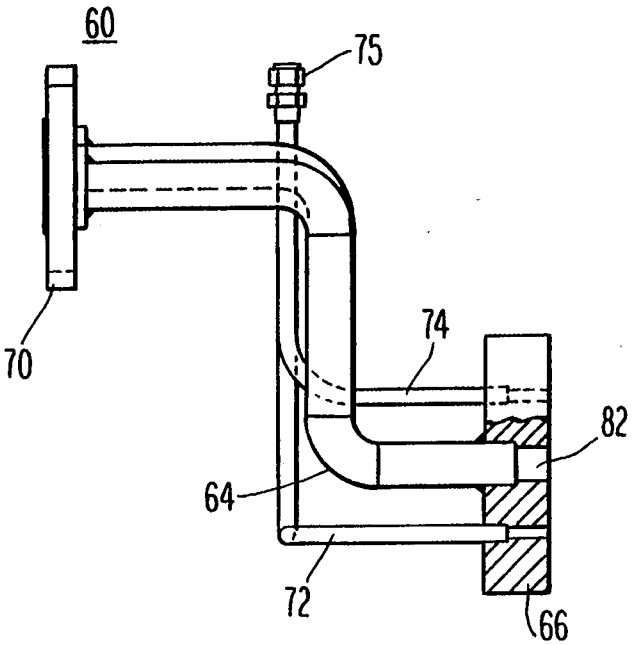

A fuel supply adapter 60 for supplying fuel to the main nozzle block 22, and thus the combustors 8, in accordance with a preferred embodiment of the present invention is shown in FIGS. 3*a* and 3*b*. Gas fuel supply pipes 62, 64 are mounted in manifold 66 such that when manifold 66 is mechanically connected to the front end 30 of nozzle block 22, the gas fuel supply pipes 62, 64 are in flow communication with annular passages 38, 40 respectively. Flanges 68, 70 are hooked up to separate gas fuel supply manifolds in a known manner such that gas is supplied to pipes 62, 64 and delivered to nozzles 28, via nozzle block 22 in the manner described above. Similarly, liquid fuel supply pipes 72, 74 are mounted in manifold 66 and connected separately, via pipe connections 75, to oil supply manifolds in a known manner for supplying liquid fuel to the annular passages 34, 36 respectively, and thus nozzles 28, in the described manner.

The present invention is not intended to be limited to the arrangement of the fuel supply pipes shown in FIGS. 3*a* and 3*b*. Moreover, the present invention is not intended to be limited to a system for supplying both gas and liquid fuel and the system can operate in accordance with the present invention with either liquid or gas fuel exclusively.

Referring once again to FIG. 1, manifold 66 is disposed in the aperture 18 of casing 12 and is bolted to the front end 30 of the nozzle block by bolts 76. Accordingly, the fuel supply pipes 62, 64 and 72, 74 extend out through aperture 18 to the outside of the cylinder casing.

Figure 4:
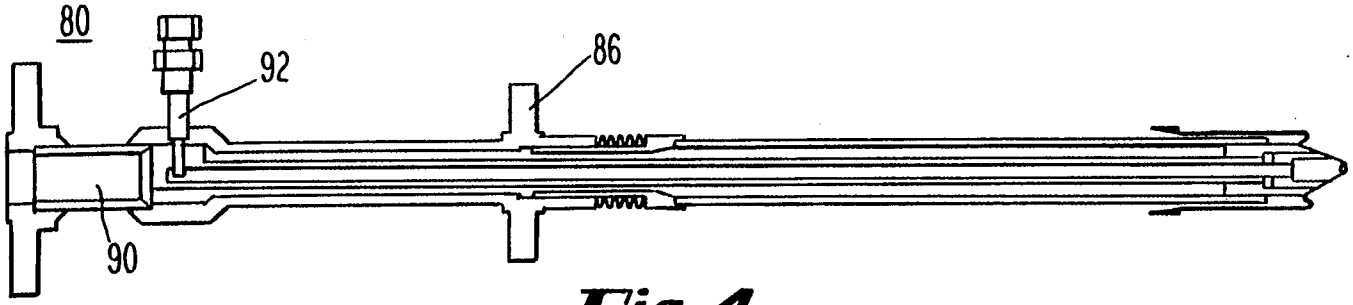
FIG. 4 shows a pilot nozzle in accordance with the present invention.

Referring to FIG. 4, a pilot nozzle 80 in accordance with the present invention is shown. As shown in FIGS. 1, 2 and 3*a–b*, the pilot nozzle extends through the central aperture 82 in the manifold 66 of the fuel supply adapter 60, and further through the central bore 84 in the main fuel nozzle block 22 such that the pilot nozzle extends into the combustor for spraying fuel therein a known manner. Flange 86 located near the center of the pilot nozzle 80 is mechanically connected to the front end of the manifold 66 by bolts 88 for securing the pilot nozzle apparatus.

Gas is supplied to the pilot nozzle through chamber 90, while liquid fuel is supplied through pipe 92, the fuel supplies for the pilot nozzle being located outside of the cylinder casing. The pilot nozzle sprays fuel into the low NOx combustors for creating a pilot flame therein in a known manner.

Thus, in accordance with the present invention, low NOx combustors can be mounted to the cylinder casing 12 and to the transition duct 14, and the necessary fuel supply apparatus can be accommodated within the existing aperture 18 in the casing, without any significant alteration of the conventional gas turbine apparatus.

Although particular embodiments of the present invention have been described and illustrated herein, it is recognized that modifications and variations may readily occur to those skilled in the art. Consequently, it is intended that the claims be intended to cover such modifications and equivalents.

We claim:

1. A gas turbine, comprising:

a compressor for producing compressed air;

a cylinder casing for receiving said compressed air from said compressor, said cylinder casing having an aperture;

a combustor in which a fuel is burned in said compressed air to produce a hot gas, said combustor disposed within said cylinder casing;

a nozzle block having a plurality of fuel nozzles for spraying said fuel into said combustor, said nozzle block having a pilot nozzle aperture and first and second ends, said first end mechanically affixed to said combustor such that said fuel nozzles extend into said combustor, said second end mechanically affixed to said cylinder casing, said nozzle block having a plurality of fuel passages in flow communication with said fuel nozzles;

a fuel supply adapter having a plurality of manifold passages, said manifold passages in flow communication with a supply of said fuel, said fuel supply adapter mechanically affixed to said nozzle block such that each one of said manifold passages is in flow communication with a corresponding one of said fuel passages;

a pilot nozzle in flow communication with a supply of said fuel, said pilot nozzle extending through said pilot nozzle aperture and into said combustor for spraying said fuel into said combustor; and a turbine section for expanding said hot gas.

2. The gas turbine according to claim 1, said fuel supply adapter further having a plurality of fuel supply pipes corresponding in number to the number of said plurality of manifold passages, each one of said plurality of fuel supply pipes in flow communication with a corresponding one of said plurality of manifold passages.

3. The gas turbine according to claim 2, wherein said fuel supply adapter has four manifold passages.

4. The gas turbine according to claim 3, wherein two of said manifold passages are supplied with gas fuel and the other two of said manifold passages are supplied with liquid oil fuel.

5. The gas turbine according to claim 1, wherein said fuel supply adapter has first, second, third and fourth manifold passages, said first and third manifold passages in flow communication with a supply of gas fuel and said second and fourth manifold passages in flow communication with a supply of liquid oil fuel, one of said fuel nozzles in flow communication with said first and second manifold passages and an adjacent one of said fuel nozzles in flow communication with said third and fourth manifold passages.

6. A gas turbine, comprising:

a compressor for producing compressed air;

a cylinder casing for receiving said compressed air from said compressor, said cylinder casing having an aperture having a first diameter;

a combustor in which a fuel is burned in said compressed air, said combustor disposed within said cylinder casing and having a combustor flange, said combustor flange having a combustor flange diameter that is substantially greater than said first diameter;

a nozzle block having a plurality of fuel nozzles for spraying said fuel into said combustor, said nozzle block having a nozzle block flange and a first end, said nozzle block flange having a nozzle block flange diameter substantially the same size as said combustor flange diameter, said nozzle block flange mechanically connected to said combustor flange such that said nozzles extend into said combustor, said first end mechanically connected to said cylinder casing over said aperture.

7. The gas turbine according to claim 6, said nozzle block further having a plurality of fuel passages in flow communication with a supply of said fuel, wherein said fuel is delivered to said nozzles through said fuel passages.

8. The gas turbine according to claim 7, further comprising fuel supply means for supplying said fuel to said fuel passages.

9. The gas turbine according to claim 8, wherein said fuel supply means is mechanically connected to said first end.

* * * * *